US011428229B2

(12) United States Patent
Lee et al.

(10) Patent No.: US 11,428,229 B2
(45) Date of Patent: Aug. 30, 2022

(54) SCROLL COMPRESSOR HAVING ENHANCED DISCHARGE STRUCTURE

(71) Applicant: LG Electronics Inc., Seoul (KR)

(72) Inventors: Howon Lee, Seoul (KR); Kangwook Lee, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 388 days.

(21) Appl. No.: 16/423,775

(22) Filed: May 28, 2019

(65) Prior Publication Data

US 2019/0360490 A1 Nov. 28, 2019

(30) Foreign Application Priority Data

May 28, 2018 (KR) ..... 10-2018-0060759

(51) Int. Cl.
*F04C 29/12* (2006.01)
*F04C 18/02* (2006.01)
(Continued)

(52) U.S. Cl.
CPC ..... *F04C 29/128* (2013.01); *F04C 18/0215* (2013.01); *F04C 18/0261* (2013.01);
(Continued)

(58) Field of Classification Search
CPC ..... F04C 29/128; F04C 18/0215; F04C 18/0261; F04C 18/0269; F04C 18/0292;
(Continued)

(56) References Cited

U.S. PATENT DOCUMENTS 4,781,549 A * 11/1988 Caillat ..... F01C 1/0246 418/150
5,152,682 A * 10/1992 Morozumi ..... F04C 23/008 418/55.1
(Continued)

FOREIGN PATENT DOCUMENTS

CN 1211687 3/1999
CN 1676882 10/2005
(Continued)

OTHER PUBLICATIONS

Chinese Office Action in Chinese Application No. 201910451031.1, dated Jul. 31, 2020, 14 pages (with English translation).
(Continued)

*Primary Examiner* — Dominick L Plakkoottam
*Assistant Examiner* — Paul W Thiede
(74) *Attorney, Agent, or Firm* — Fish & Richardson P.C.

(57) ABSTRACT

A scroll compressor is disclosed, which comprises an auxiliary discharge path capable of sufficiently making sure of a discharge area at an initial discharge stage. The compressor comprises a fixed scroll including a fixed end plate portion and a fixed wrap, and an orbiting scroll including an orbiting end plate portion and an orbiting wrap, wherein a discharge hole is formed in the fixed end plate portion, and an auxiliary discharge path for connecting a side of the orbiting wrap with a bottom surface of the orbiting wrap is provided to be communicated with the discharge hole, whereby a compressed refrigerant may be discharged through the auxiliary discharge path.

16 Claims, 14 Drawing Sheets

(51) Int. Cl.
*F04C 23/02* (2006.01)
*F04C 29/02* (2006.01)

(52) U.S. Cl.
CPC ..... *F04C 18/0269* (2013.01); *F04C 18/0292* (2013.01); *F04C 23/02* (2013.01); *F04C 29/02* (2013.01); *F04C 2210/26* (2013.01); *F04C 2240/10* (2013.01); *F04C 2240/20* (2013.01); *F04C 2240/40* (2013.01)

(58) Field of Classification Search
CPC ..... F04C 23/02; F04C 29/02; F04C 2210/26; F04C 2240/10; F04C 2240/20; F04C 2240/40
See application file for complete search history.

(56) References Cited

U.S. PATENT DOCUMENTS

| | | | | |
|---|---|---|---|---|
| 5,242,283 | A | 9/1993 | Mori et al. | |
| 5,249,943 | A | 10/1993 | Kuroki et al. | |
| 10,041,493 | B2 * | 8/2018 | Choi | F04C 18/0215 |
| 11,125,230 | B2 * | 9/2021 | Mizushima | F04C 18/0246 |
| 11,131,305 | B2 * | 9/2021 | Mizushima | F04C 18/02 |
| 2006/0269432 | A1 | 11/2006 | Lifson | |
| 2007/0036668 | A1 | 2/2007 | Lifson et al. | |
| 2008/0138228 | A1 * | 6/2008 | Terauchi | F01C 21/10 418/55.6 |
| 2016/0047380 | A1 * | 2/2016 | Kim | F04C 23/008 417/410.5 |
| 2017/0306952 | A1 | 10/2017 | Choi et al. | |
| 2018/0073505 | A1 | 3/2018 | Choi et al. | |
| 2018/0073507 | A1 * | 3/2018 | Choi | F04C 18/0292 |
| 2019/0010945 | A1 * | 1/2019 | Choi | F04C 29/12 |

FOREIGN PATENT DOCUMENTS

| | | | | |
|---|---|---|---|---|
| CN | 101415906 | | 4/2009 | |
| CN | 105190042 | | 12/2015 | |
| CN | 105370572 | | 3/2016 | |
| CN | 107313931 | | 11/2017 | |
| JP | 04234590 | A * | 8/1992 | F04C 18/0292 |
| JP | 08021381 | A * | 1/1996 | |
| JP | 2009228478 | | 10/2009 | |
| KR | 20160020190 | | 2/2016 | |
| WO | WO-2018021245 | A1 * | 2/2018 | F04C 18/0246 |

OTHER PUBLICATIONS

Extended European Search Report in European Application No. 19176711.0, dated Oct. 18, 2019, 8 pages.

* cited by examiner

Discharge starting time + 30°

SCROLL COMPRESSOR HAVING ENHANCED DISCHARGE STRUCTURE

CROSS-REFERENCE TO RELATED APPLICATIONS

This application claims the benefit of the Korean Patent Application No. 10-2018-0060759, filed on May 28, 2018, which is hereby incorporated by reference as if fully set forth herein.

BACKGROUND OF THE INVENTION

Field of the Invention

The present invention relates to a scroll compressor, and more particularly, to a scroll compressor having an enhanced discharge structure to discharge a refrigerant compressed in a compression chamber.

Discussion of the Related Art

Generally, a compressor is an apparatus configured to convert mechanical energy into compression energy of a compressible fluid. The compressor may be categorized into a reciprocating compressor, a rotary compressor, a vane compressor, and a scroll compressor in accordance with a method of compressing a fluid.

The scroll compressor includes a fixed scroll having a fixed wrap and an orbiting scroll having an orbiting wrap engaged with the fixed wrap. The scroll compressor allows the orbiting scroll to perform an orbiting movement on the fixed scroll.

The scroll compressor is provided with a compression chamber formed between the fixed wrap and the orbiting wrap in accordance with the orbiting movement of the orbiting scroll. The compression chamber formed between the fixed wrap and the orbiting wrap performs suction and compression of a refrigerant using a continuous volume change.

The scroll compressor has an advantage capable of obtaining a relatively high compression ratio compared to other types of compressors. Also, the scroll compressor has an advantage capable of obtaining a stable torque because suction, compression, and discharge strokes of a refrigerant are smoothly performed.

Characteristics of the scroll compressor are determined by shapes of the fixed wrap and the orbiting wrap. Although the fixed wrap and the orbiting wrap may have random shapes, the fixed wrap and the orbiting wrap generally have a form of an involute curve which is easy to process.

The orbiting scroll generally has an orbiting end plate formed in a circular plate shape and the orbiting wrap formed at one side of the orbiting end plate.

A scroll compressor in which a point at which an eccentric portion and an orbiting scroll of a rotary shaft are coupled is formed on the same plane (a position at which the eccentric portion and the orbiting scroll overlap along a rotary shaft) as that of the orbiting wrap is disclosed in the Korean Patent Registration No. 10-1059880, entitled "Scroll Compressor".

In the scroll compressor having the above structure, since an action point on which a repulsive point of a refrigerant acts and an action point of a reaction force opposite to the repulsive force act at a same height in directions opposite to each other, a problem in which the orbiting scroll is inclined may be solved.

The scroll compressor includes a discharge hole configured to discharge a refrigerant compressed in each compression chamber. The refrigerant compressed in the compression chamber is discharged through the discharge hole, however, there is a problem in that it is difficult to make sure of a discharge area of the discharge hole at an initial discharge stage because the discharge hole is covered by the orbiting wrap. If the discharge area is not obtained sufficiently, discharge resistance becomes greater, whereby a smooth discharge is not performed.

However, if the discharge hole is processed at a great size to enlarge a discharge area, a crank angle in which the compression chamber and the discharge hole start to be communicated with each other is brought forward. If the crank angle in which the compression chamber and the discharge hole are communicated with each other is brought forward, deterioration of a compression ratio occurs. Therefore, there is a limitation in that a size of the discharge hole cannot be enlarged to maintain the compression ratio.

PRIOR ART REFERENCE

Patent Reference (Patent Reference 1) Korean Patent Registration No. 10-1059880 (laid-open date: Aug. 29, 2011)

SUMMARY OF THE INVENTION

Accordingly, the present invention is directed to a scroll compressor having an enhanced discharge structure that substantially obviates one or more problems due to limitations and disadvantages of the related art.

An object of the present invention is to provide a scroll compressor having an enhanced discharge structure capable of making sure of a sufficient discharge area at an initial discharge stage to reduce a discharge resistance at an initial discharge stage.

Another object of the present invention is to provide an auxiliary discharge path structure capable of making sure of a discharge area while maintaining a compression ratio of a scroll compressor.

Other object of the present invention is to provide a scroll compressor that reduces a problem that an orbiting scroll is subjected to seizure with a fixed scroll.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a compressor according to the present invention comprises an auxiliary discharge path capable of sufficiently making sure of a discharge area at an initial discharge stage. The compressor according to the present invention comprises a fixed scroll including a fixed end plate portion and a fixed wrap, and an orbiting scroll including an orbiting end plate portion and an orbiting wrap, wherein a discharge hole is formed in the fixed end plate portion, and an auxiliary discharge path for connecting a side of the orbiting wrap with a bottom surface of the orbiting wrap is provided to be communicated with the discharge hole, whereby a compressed refrigerant may be discharged through the auxiliary discharge path.

The compressor according to the present invention provides a structure of an auxiliary discharge path to make sure of a discharge area while maintaining a compression ratio. To this end, the auxiliary discharge path provides a structure in which an inlet formed at a side of the orbiting wrap is arranged inside a side area of the orbiting wrap that forms a compression chamber at a discharge starting time.

Also, the compressor of the present invention provides a structure in which an orbiting scroll may be prevented from being subjected to seizure with a fixed scroll. To this end, the compressor according to the present invention provides a structure in which an auxiliary discharge path is formed on a bottom surface of the orbiting wrap having a friction with the fixed end plate portion in a recessed groove shape.

The compressor according to the present invention provides a structure in which an auxiliary discharge path is provided at a center portion of an orbiting wrap to discharge a compressed refrigerant through the auxiliary discharge path. This structure results in an attenuation effect of discharge loss by enlarging an area to which the compressed refrigerant can be discharged.

The compressor according to the present invention comprises an auxiliary discharge path connected from a side of an orbiting wrap to a bottom surface of the orbiting wrap, wherein an inlet of the auxiliary discharge path, which is formed at a side, is arranged inside a compression chamber area at a discharge starting time, whereby a discharge area may be enlarged without a change of a compression ratio.

Also, the compressor according to the present invention comprises an auxiliary discharge path formed on a bottom surface of an orbiting wrap, whereby a fixed end plate portion may be cooled by a refrigerant passing through the auxiliary discharge path. The auxiliary discharge path results in reducing a friction area by reducing a sectional area of the bottom surface of the orbiting wrap in which seizure occurs. As a result, a problem that the bottom surface of the orbiting wrap is subjected to seizure with the fixed end plate portion may be solved.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the detailed embodiments of the present invention, examples of which are illustrated in the accompanying drawings. Technical spirits of the present invention are not limited to the embodiments as suggested, and the person who understands the spirits of the present invention may easily devise other embodiments within the range of the same spirits.

Hereinafter, the preferred embodiments of the present invention will be described in detail with reference to the accompanying drawings. Wherever possible, the same reference numbers will be used throughout the drawings to refer to the same or like parts.

Figure 1:
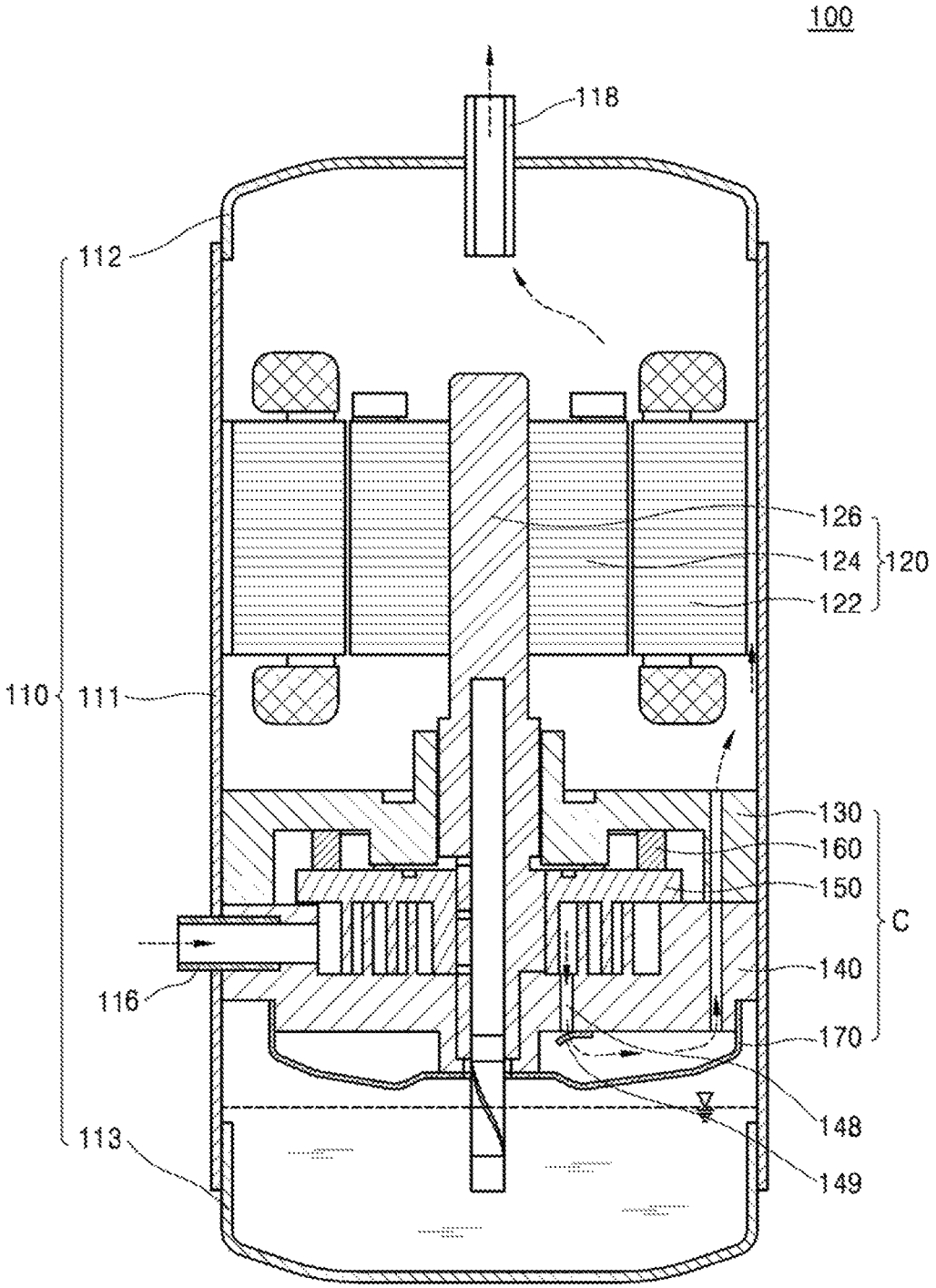
FIG. 1 is a sectional view illustrating an entire structure of a scroll compressor according to the present invention.

FIG. 1 is a sectional view illustrating an entire structure of a scroll compressor according to the present invention.

The scroll compressor to the embodiment of the present invention comprises a casing 110 forming a sealed inner space, a driving motor 120 arranged at an upper portion of the inner space, and a compression portion C performing suction and compression of a refrigerant in accordance with a rotational force of the driving motor.

The casing 110 includes a cylindrical shell 111 of a cylindrical shape, a first shell coupled to an upper portion of the cylindrical shell 111, and a second shell 113 coupled to a lower portion of the cylindrical shell 111.

If the first shell 112 is arranged at the upper portion and the second shell 113 is arranged at the lower portion, the first shell 112 may correspond to an upper shell, and the second shell 113 may correspond to a lower shell.

A refrigerant suction pipe 116 and a refrigerant discharge portion 118 are coupled to the casing 110. A refrigerant is sucked into the compressor 100 through the refrigerant suction pipe 116. The sucked refrigerant is compressed in the compression portion C and then discharged from the compressor 100 through the refrigerant discharge portion 118.

As shown, the refrigerant suction pipe 116 may directly be connected to the compression portion C by passing through the cylindrical shell 111. The refrigerant discharge portion 118 may be provided in the compressor 100 in a shape passing through the first shell 112.

The driving motor 120 includes a stator 122, a rotor 124, and a rotary shaft 126. The rotary shaft 126 is coupled to the rotor in a single body. Also, the rotary shaft 126 is arranged to pass through the compression portion. The rotary shaft serves to transfer a rotational power to the compression portion.

The compression portion C includes a main frame 130, a fixed scroll 140, an orbiting scroll 150, an Oldham ring 160, and a discharge cover 170.

The main frame 130 forms a portion of external appearance of the compression portion C. If the refrigerant discharge portion 118 is arranged toward the upper portion, the main frame 130 may correspond to the upper portion of the compression portion C.

An outer circumference of the main frame 130 is coupled to an inner circumference of the casing. The main frame 130 serves to support the rotary shaft 126 that passes through the main frame 130. The main frame 130 maintains a fixed state without being rotated with the rotary shaft 126.

The fixed scroll 140 may be arranged in the main frame 130 to be far away from the refrigerant discharge portion 118. For example, the fixed scroll 140 may be arranged at a lower portion of the main frame 130. An outer circumference of the fixed scroll 140 is coupled to the inner circumference of the casing 110. The fixed scroll 140 serves to support the rotary shaft 126 that passes through the fixed scroll 140. The fixed scroll 140 maintains a fixed state without being rotated with the rotary shaft 126.

The fixed scroll 140 includes a discharge hole 148 through which a compressed refrigerant is discharged. A discharge valve 149 is arranged in the discharge hole 148. The discharge valve 149 has a structure which is opened by a pressure of the refrigerant. The discharge valve 149 serves to allow the refrigerant which is opened and then compressed to be discharged from the compression chamber if the refrigerant which is discharged reaches a certain pressure.

The orbiting scroll 150 may be arranged between the main frame 130 and the fixed scroll 140. The orbiting scroll 150 may be received in the main frame 130 and the fixed scroll 140. The orbiting scroll 150 is coupled to an eccentric portion **126*b* of the rotary shaft 126. The eccentric portion 126*b* may be provided to be eccentric or protruded from the rotary shaft 126 in a diameter direction. The eccentric portion 126*b* is eccentrically rotated by rotation of the rotary shaft 126. The orbiting scroll 150 performs an orbiting movement by means of an eccentric rotation of the eccentric portion 126*b***.

The eccentric portion **126*b* is rotatably coupled to the orbiting scroll 150**.

The Oldham ring 160 is arranged between the orbiting scroll 150 and the main frame 130. The Oldham ring 160 serves to allow the orbiting scroll 150 to perform an orbiting movement without performing rotation.

The discharge cover 170 may be arranged in the fixed scroll 140 to be far away from the refrigerant discharge portion 118. For example, the discharge cover 170 may be arranged at the lower portion of the fixed scroll 140. The discharge cover 170 may serve to separate the refrigerant and oil, which are discharged from the compression chamber, from each other. The oil circulates inside the compressor. The oil serves to improve tight sealing of the compression chamber, lubricate friction portions, and cool heat generated from the friction portions. The oil moves together with the refrigerant in a state that the oil is mixed with the refrigerant, or is stored by being separated from the refrigerant.

The oil may be stored in one side of the casing 110. For example, the oil may be stored below the lower portion of the casing 110. The oil may be stored in a lower space of the discharge cover 170 in the inner space of the casing.

Figure 2:
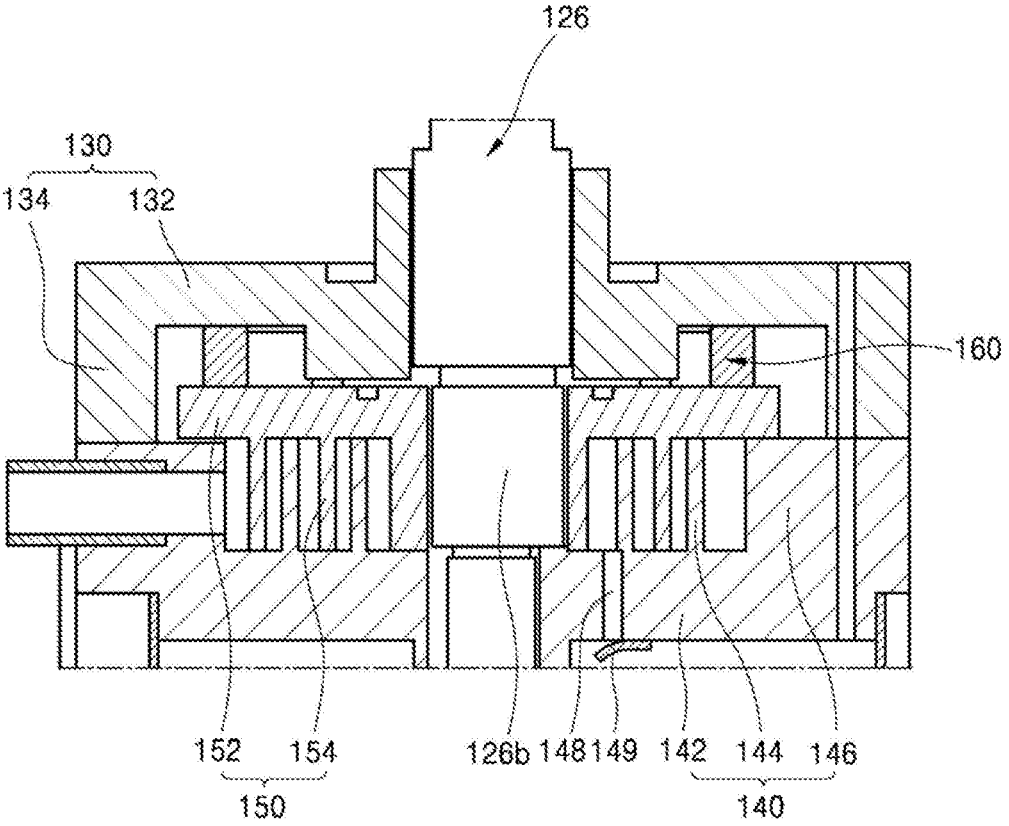
FIG. 2 is an enlarged view illustrating a compression portion of a compressor according to the present invention.
Figure 3:
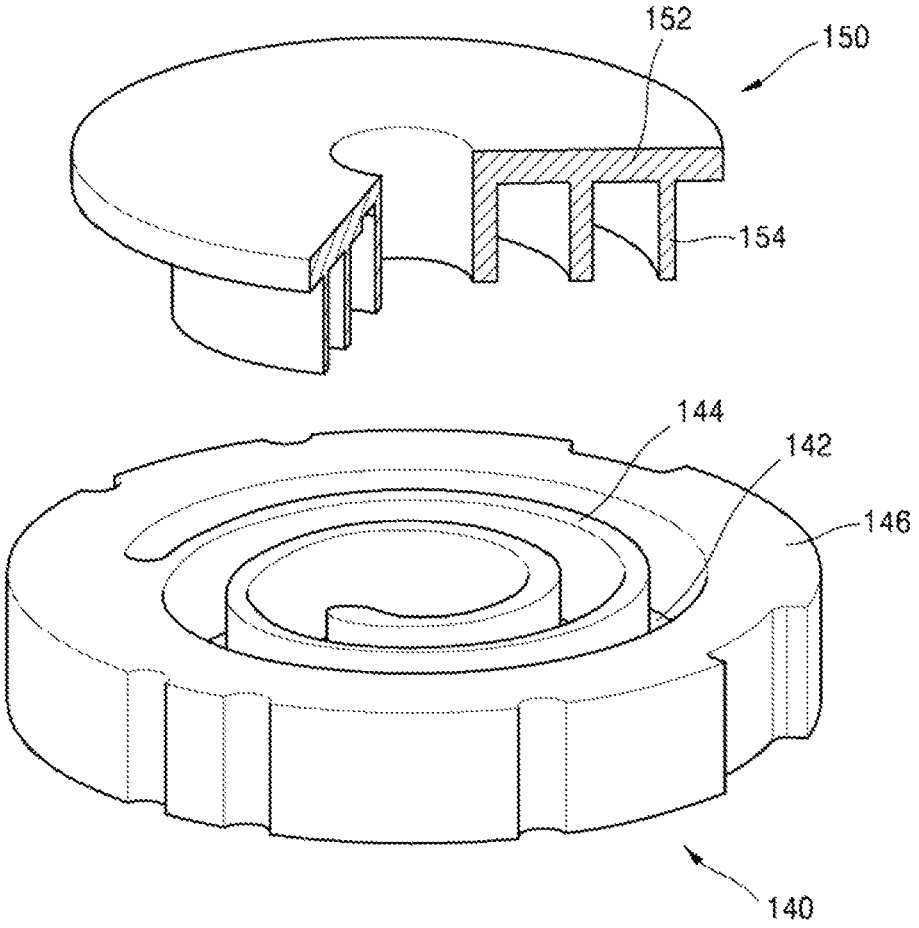
FIG. 3 is a partially exploded perspective view illustrating a compression portion shown in FIG. 1.

After the stored oil moves by being sucked into the rotary shaft 126, the oil may be supplied to a necessary portion of the compression portion C. FIG. 2 is an enlarged view illustrating a compression portion of a compressor according to the present invention, and FIG. 3 is a partially exploded perspective view illustrating a compression portion shown in FIG. 1.

As described above, the compression portion includes a main frame 130, a fixed scroll 140, an orbiting scroll 150, an Oldham ring 160, and a discharge cover 170.

The fixed scroll 140 includes a fixed end plate portion 142 having a circular plate shape and a fixed wrap 144 formed to be protruded from the fixed end plate portion 142. The discharge hole 148 is formed to pass through the fixed end plate portion 142.

A portion where the discharge hole 148 is connected with the compression chamber may be referred to as a discharge inlet. A portion where the discharge hole 148 is connected with the inside of the discharge cover 170 may be referred to as a discharge outlet. The discharge valve 149 is arranged at the discharge outlet.

The orbiting scroll 150 includes an orbiting end plate portion 152 having a circular plate shape and an orbiting wrap 154 formed to be protruded from the orbiting end plate portion 152.

The orbiting end plate portion 152 may be arranged in parallel with the fixed end plate portion 142. The orbiting wrap 154 may be formed to be protruded toward the fixed end plate portion 142 from one surface of the orbiting end plate portion 152.

One surface (or bottom surface) of the orbiting wrap 154 may be tightly adhered to the fixed end plate portion 142. An exposed surface corresponding to a free end of the orbiting wrap 154 may be in contact with the fixed end plate portion 142. The fixed wrap 144 may be formed to be protruded from one surface of the fixed end plate portion 142. For example, the fixed wrap 144 may be protruded toward the orbiting end plate portion 152 from the fixed end plate portion 142.

One surface of the fixed wrap 144 may be tightly adhered to the orbiting end plate portion 152. That is, an exposed surface corresponding to a free end of the fixed wrap 144 may be tightly adhered to the orbiting end plate portion 152.

The orbiting wrap 154 may be engaged with the fixed wrap 144 to form a sealed space (hereinafter, referred to as compression chamber). If the orbiting wrap 154 performs an orbiting movement, the sealed space moves along a spiral track in a direction of the rotary shaft and its volume is reduced.

A first compression chamber and a second compression chamber may be formed between the orbiting wrap and the fixed wrap.

The first compression chamber may be formed between an inner surface of the fixed wrap and an outer surface of the orbiting wrap. The first compression chamber and the second compression chamber may move to the discharge hole after suction is completed with a phase difference. In other words, if the rotary shaft 120 is rotated, it may seem that the first compression chamber and the second compression chamber move to the discharge hole. The first compression chamber and the second compression chamber may be combined with each other in a position close to the discharge hole. That is, the first compression chamber and the second compression chamber may be incorporated into one compression chamber at a position near the discharge hole. The fixed scroll 140 is provided with the discharge hole 148 in the fixed end plate portion 142. The discharge inlet of the discharge hole 148 may be opened or closed in accordance with the orbiting movement of the orbiting wrap 154. The discharge valve 149 is provided at the discharge outlet of the discharge hole 148. Switching of the discharge valve 149 may be adjusted by a pressure of the refrigerant which is discharged.

The refrigerant which is discharged through the discharge hole 148 may move to the discharge cover 170 and then pass through the driving motor 120 through the compression portion C. Afterwards, the refrigerant may be discharged to the outside of the compressor 100 through the refrigerant discharge portion 118.

Figure 4:
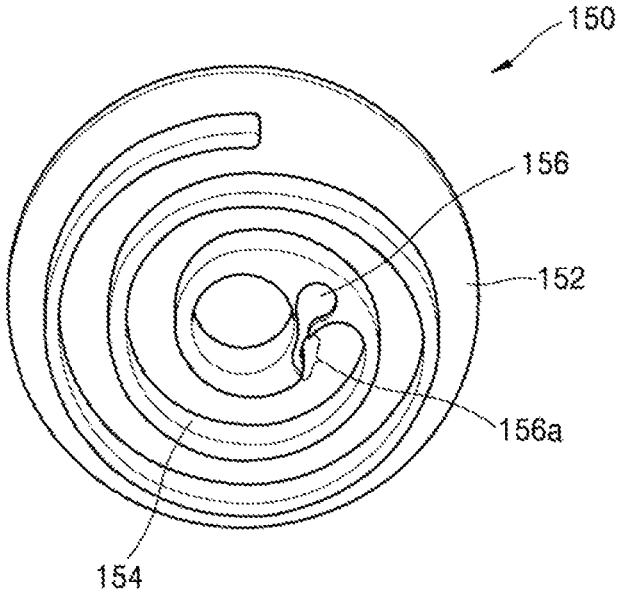
FIG. 4 is a perspective view respectively illustrating an orbiting scroll and a fixed scroll shown in FIG. 1.
Figure 4:
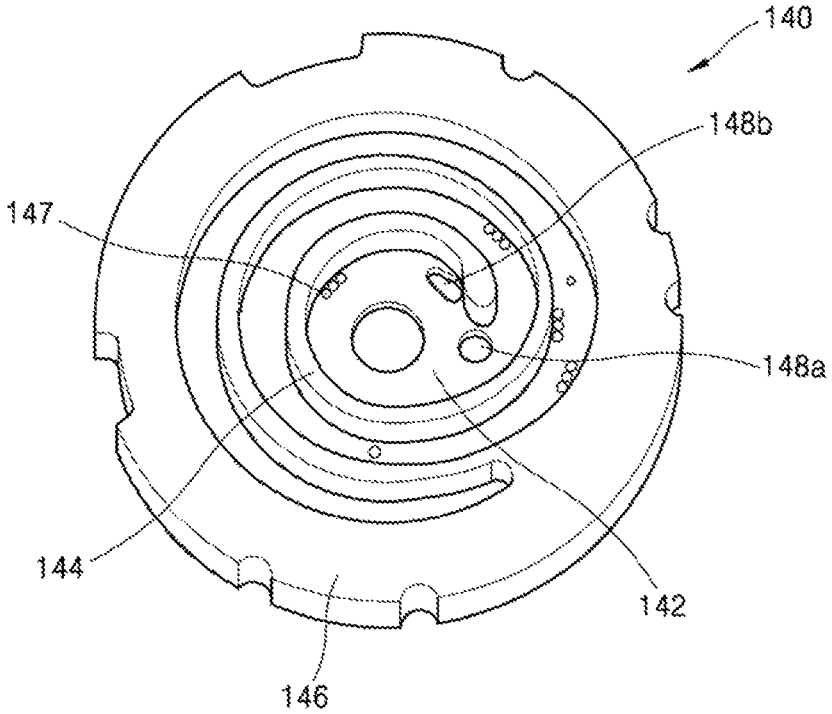

FIG. 4 is a perspective view respectively illustrating an orbiting scroll and a fixed scroll shown in FIG. 1.

As shown, discharge holes 148*a* and 148*b* are formed in the fixed end plate portion 142 of the fixed scroll 140. The discharge hole may include a plurality of discharge holes as shown. In FIG. 4, a discharge hole of a right side may be referred to as a first discharge hole 148*a*, and another discharge hole may be referred to as a second discharge hole 148*b*.

As described above, the refrigerant compressed in the compression chamber is discharged to the outside of the compression chamber through the discharge holes 148*a* and 148*b*. Switching of the discharge holes 148*a* and 148*b* is adjusted by the bottom surface of the orbiting wrap 154. The refrigerant is resisted when passing through the discharge holes 148*a* and 148*b*, and if a discharge area (area opened to move the refrigerant) of the discharge holes 148*a* and 148*b* is narrow, a flow velocity becomes fast, whereby discharge resistance is increased.

The compression chamber formed between the orbiting wrap 154 and the fixed wrap 144 has a volume which is reduced in accordance with the orbiting movement of the orbiting scroll 150, and moves to the center of the orbiting scroll.

A bypass hole 147 is formed in the fixed end plate portion 142. The bypass hole 147 is arranged on a moving path of the compression chamber.

The bypass hole 147 provides a passage through which an overcompressed refrigerant is discharged. A portion where the bypass hole 147 is connected with the compression chamber may be referred to as an inlet, and its opposite portion may be referred to as an outlet.

A bypass valve (not shown) is arranged at the outlet of the bypass hole 147. Refrigerants of a liquid state may be mixed with each other and sucked into the compression chamber in accordance with an operation state of the compressor. If the refrigerants of the liquid state are mixed, their overcompression may be generated in the compression chamber.

If overcompression of the refrigerant is generated, the bypass hole 147 provides a passage through which the overcompressed refrigerant is discharged. The refrigerant discharged through the bypass hole 147 moves to the inside of the discharge cover 170 in the same manner as the refrigerant discharged through the discharge holes 148*a* and 148*b*.

The compressor of the related art provides a structure in which a compressed refrigerant is discharged through the discharge holes 148*a* and 148*b* formed in the fixed scroll 140. This structure has a drawback in that discharge loss is increased due to a narrow discharge area of the discharge hole at the initial discharge stage.

The compressor according to the present invention is characterized in that an auxiliary discharge path 156 is provided in the orbiting scroll 150. The auxiliary discharge path 156 serves to allow the refrigerant compressed at a discharge starting time to be discharged to the discharge hole 148*a* or 148*b* by passing through the auxiliary discharge path 156.

Figure 5:
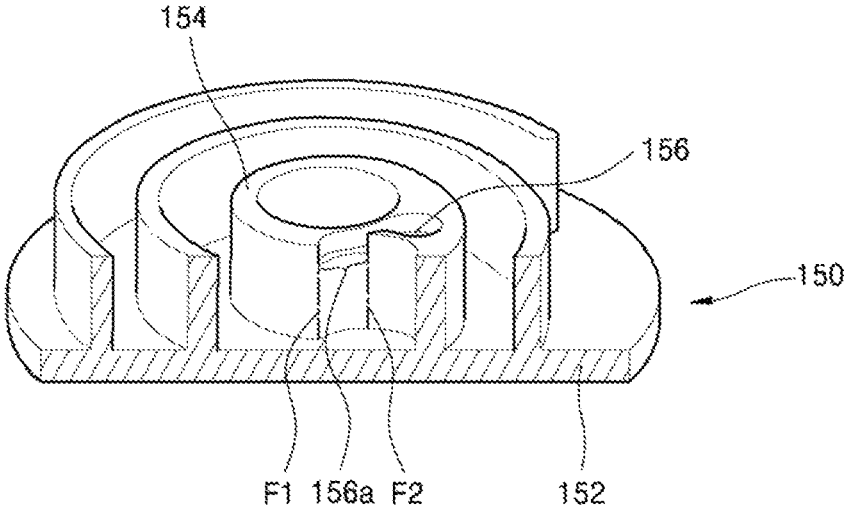
FIG. 5 is a partially exploded perspective view illustrating an orbiting scroll according to the first embodiment of the present invention.

FIG. 5 is a partially exploded perspective view illustrating an orbiting scroll according to the first embodiment of the present invention.

The orbiting scroll 150 according to the first embodiment of the present invention includes an orbiting end plate portion 152 having a circular plate shape, an orbiting wrap 154 formed to be protruded from the orbiting end plate portion 152 at a certain height, and an auxiliary discharge path 156 formed at a center portion of the orbiting wrap 154 in a groove shape which is recessed.

As shown, the compressor according to the first embodiment of the present invention includes the auxiliary discharge path 156 at the center portion of the orbiting scroll.

The auxiliary discharge path 156 is formed on the bottom of the orbiting wrap 154 in a recessed groove shape. Also, the auxiliary discharge path 156 is formed to partially remove a side of the orbiting wrap 154, whereby an inlet 156*a* is formed at the side of the orbiting wrap 154.

That is, the auxiliary discharge path 156 may be provided in such a manner that the side of the orbiting wrap 154 is partially recessed. Therefore, the auxiliary discharge path 156 may form the inlet 156*a* through which the refrigerant of the compression chamber enters one surface of the orbiting wrap 154.

It is preferable that the inlet 156*a* of the auxiliary discharge path 156 is arranged inside a side area of the orbiting wrap, which forms the compression chamber at a discharge starting time. The inlet 156*a* of the auxiliary discharge path 156 is to maintain a compression ratio by allowing the refrigerant not to move between the compression chambers therethrough.

In other words, the inlet 156*a* of the auxiliary discharge path 156 forms a wall of a single compression chamber until the discharge starts. If the inlet 156*a* of the auxiliary discharge path 156 is formed over two compression chambers, compression efficiency may be deteriorated due to movement of the refrigerant between the two compression chambers.

That is, the auxiliary discharge path 156 may be provided such that its inlet faces the compression chamber provided near the discharge hole 148. The auxiliary discharge path 156 may be provided such that its inlet is arranged to be far away from the rotary shaft 120.

The compressor according to the present invention does not give a change in a crank angle of the discharge starting time because the inlet 156*a* of the auxiliary discharge path 156 formed in the orbiting wrap 154 is arranged inside the side area, which forms the compression chamber at the discharge starting time. Therefore, the compressor according to the present invention may increase a discharge area of the discharge hole without reducing the compression ratio.

Also, in the compressor according to the present invention, the auxiliary discharge path is formed on one surface (or bottom surface) of the center portion of the orbiting wrap in a recessed groove shape. In other words, the bottom surface close to the center portion of the orbiting wrap 154 is partially removed. That is, the auxiliary discharge path may be provided in such a manner that an exposed surface of the center portion of the orbiting wrap is recessed.

The bottom surface of the center portion of the orbiting wrap is a portion tightly adhered to the fixed end plate portion 142 (FIG. 4). The bottom surface of the center portion of the orbiting wrap 154 may be subjected to seizure with the fixed end plate portion 142 during operation of the compressor.

Since a partial area of the bottom surface of the center portion of the orbiting wrap according to the present invention becomes the auxiliary discharge path 156, an area of a portion subjected to seizure with the fixed end plate portion 142 may be reduced.

Also, the refrigerant moves through the auxiliary discharge path 156, and the surface of the fixed end plate portion 142 may be cooled by the refrigerant which is moving, whereby seizure of the orbiting wrap may be more avoided. Also, since the oil moves together with the refrigerant, the oil may be supplied between one surface of the orbiting wrap and the fixed end plate portion.

The auxiliary discharge path 156 has a groove shape from which a certain area is removed from one surface of the orbiting wrap 154. The auxiliary discharge path 156 is formed over the bottom surface (exposed surface) of the orbiting wrap 154 and the side of the orbiting wrap 154.

A side section of the orbiting wrap 154 removed by the auxiliary discharge path 156 becomes the inlet 156*a* of the auxiliary discharge path 156, and a bottom section of the orbiting wrap 154 removed by the auxiliary discharge path 156 becomes the outlet of the auxiliary discharge path 156.

The refrigerant compressed in the compression chamber enters the inlet of the auxiliary discharge path 156 formed at the side of the orbiting wrap 154 and is discharged through the discharge hole 148*a* or 148*b* (FIG. 4) formed in the fixed scroll by passing through the outlet of the auxiliary discharge path formed on the bottom surface of the orbiting wrap 154.

Preferably, the inlet 156*a* of the auxiliary discharge path 156 is arranged inside a compression chamber area at the discharge starting time. This is to maintain the compression ratio of the compressor.

In the shown embodiment, line F1 and line F2 denote lines where the orbiting wrap adjoins the fixed wrap at the discharge starting time. Preferably, the inlet 156*a* of the auxiliary discharge path 156 is arranged between the line F1 and the line F2.

If the inlet 156*a* of the auxiliary discharge path 156 is formed to get out of the line F1 or the line F2, the refrigerant passes through the inlet of the auxiliary discharge path 156 at the portion where the orbiting wrap adjoins the fixed wrap during compression. At this time, the refrigerant may move (leak) between the compression chambers. If leakage of the refrigerant occurs between the compression chambers before the discharge starting time, a problem may occur in that efficiency of the compressor is deteriorated or the compression ratio is lowered.

Preferably, a depth of the auxiliary discharge path 156 is formed within the range of 10% to 30% of a height of the orbiting wrap. If the depth of the auxiliary discharge path 156 is formed to be less than 10%, a discharge area additionally obtained through the inlet 156*a* of the auxiliary discharge path 156 is small, whereby an attenuation effect of discharge resistance is low. If the depth of the auxiliary discharge path 156 exceeds 30%, a volume of the auxiliary discharge path 156 is increased, whereby a problem occurs in that a flow rate of the refrigerant staying in the auxiliary discharge path 156 is increased.

The auxiliary discharge path 156 formed in the orbiting wrap 154 reduces a problem that the orbiting wrap 154 is subjected to seizure with the fixed end plate portion of the fixed scroll.

The center portion of the orbiting wrap 154 has a friction area with the fixed end plate portion, which is relatively greater than the other portion of the orbiting wrap. Also, the center portion of the orbiting wrap 154 has a moving speed which is relatively slow with respect to the fixed end plate portion. Therefore, the center portion of the orbiting wrap 154 is more likely to be subjected to seizure with the fixed end plate portion 142 than the other portion of the orbiting wrap 154. Seizure of the orbiting wrap 154 may be generated due to a lack or overheat of oil.

In order to prevent seizure from being generated, it is preferable to reduce a friction area or lower a temperature of a friction portion.

The orbiting wrap according to the present invention includes the auxiliary discharge path 156 at the center portion. The auxiliary discharge path 156 is formed in a shape from which the center portion of the orbiting wrap 154 is removed, whereby a downsizing effect of a friction area with the fixed end plate portion is obtained. Also, the refrigerant moves through the auxiliary discharge path 156, and a cooling effect of the fixed end plate portion 142 which is in contact with the refrigerant is obtained.

Therefore, the auxiliary discharge path 156 formed in the orbiting wrap 154 results in an attenuation effect of seizure between the orbiting wrap 154 and the fixed wrap 144.

Figure 6:
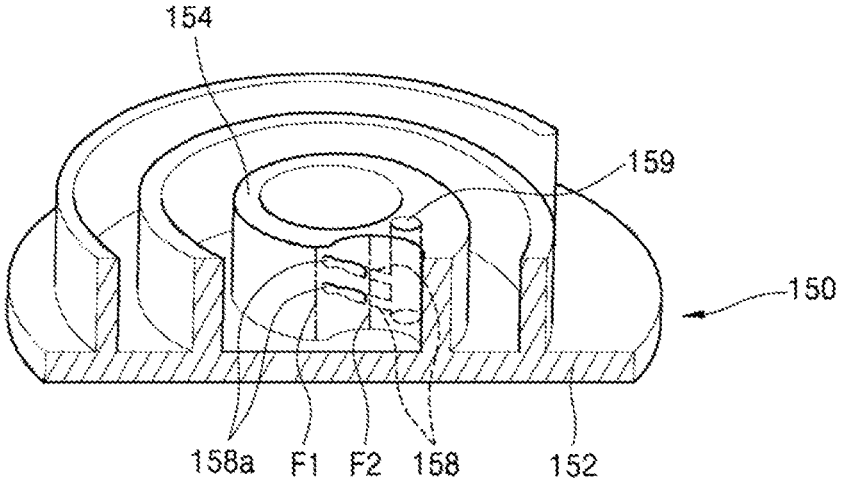
FIG. 6 is a partially exploded perspective view illustrating an orbiting scroll according to the second embodiment of the present invention.

FIG. 6 is a partially exploded perspective view illustrating an orbiting scroll according to the second embodiment of the present invention.

The auxiliary discharge path of the orbiting scroll according to the second embodiment of the present invention includes an inlet path 158 and an outlet path 159. The refrigerant of the compression chamber may enter the inlet path 158 and then move to the outlet path 159.

The inlet path 158 is formed toward the inside of the orbiting wrap 154 from the side of the orbiting wrap 154. The outlet path 159 is formed inside the orbiting wrap 154 to be communicated with the inlet path 158 on the bottom surface of the orbiting wrap 154.

Although the auxiliary discharge path 156 of the first embodiment has a single groove shape for connecting the side of the orbiting wrap 154 with the bottom surface, the auxiliary discharge paths 158 and 159 of the second embodiment have a structure in which the inlet path 158 connected to the side of the orbiting wrap 154 and the outlet path 159 connected to the bottom surface of the orbiting wrap 154 are connected with each other.

The auxiliary discharge paths 158 and 159 of the second embodiment may be provided to pass through the orbiting wrap.

The inlet path 158 is formed toward the inside from the side of the orbiting wrap 154 in a horizontal direction. That is, the inlet path 158 may be provided to pass through the center portion of the orbiting wrap 154 in a diameter direction of the rotary shaft or a direction inclined with respect to the rotary shaft.

The outlet path 159 is formed on one surface of the orbiting wrap 154 in a longitudinal direction to be communicated with the inlet path 158. That is, the outlet path 159 may be provided to be communicated with the inlet path 158 on one surface where the orbiting wrap 154 faces the fixed scroll by passing through the orbiting wrap 154.

The refrigerant compressed in the compression chamber may be discharged to the discharge hole by passing through the inlet path 158 and the outlet path 159.

Preferably, the inlet 158*a* of the inlet path 158 is arranged inside the compression chamber area at the discharge starting time in the same manner as the first embodiment.

Although two inlet paths 158 and one outlet path 159 are formed in the shown embodiment, one inlet path 158 and one outlet path 159 may be formed or a plurality of outlet paths 159 may be formed.

The auxiliary discharge path of the second embodiment results in an enlarging effect of the discharge area and an attenuation effect of seizure of the orbiting wrap in the same manner as the auxiliary discharge path of the first embodiment.

FIGS. 7 to 11 are views illustrating positions of a discharge hole and an auxiliary discharge path every 10° until a crank angle is additionally rotated at 40° from a discharge starting time of a compressor according to the first embodiment of the present invention.

Figure 7:
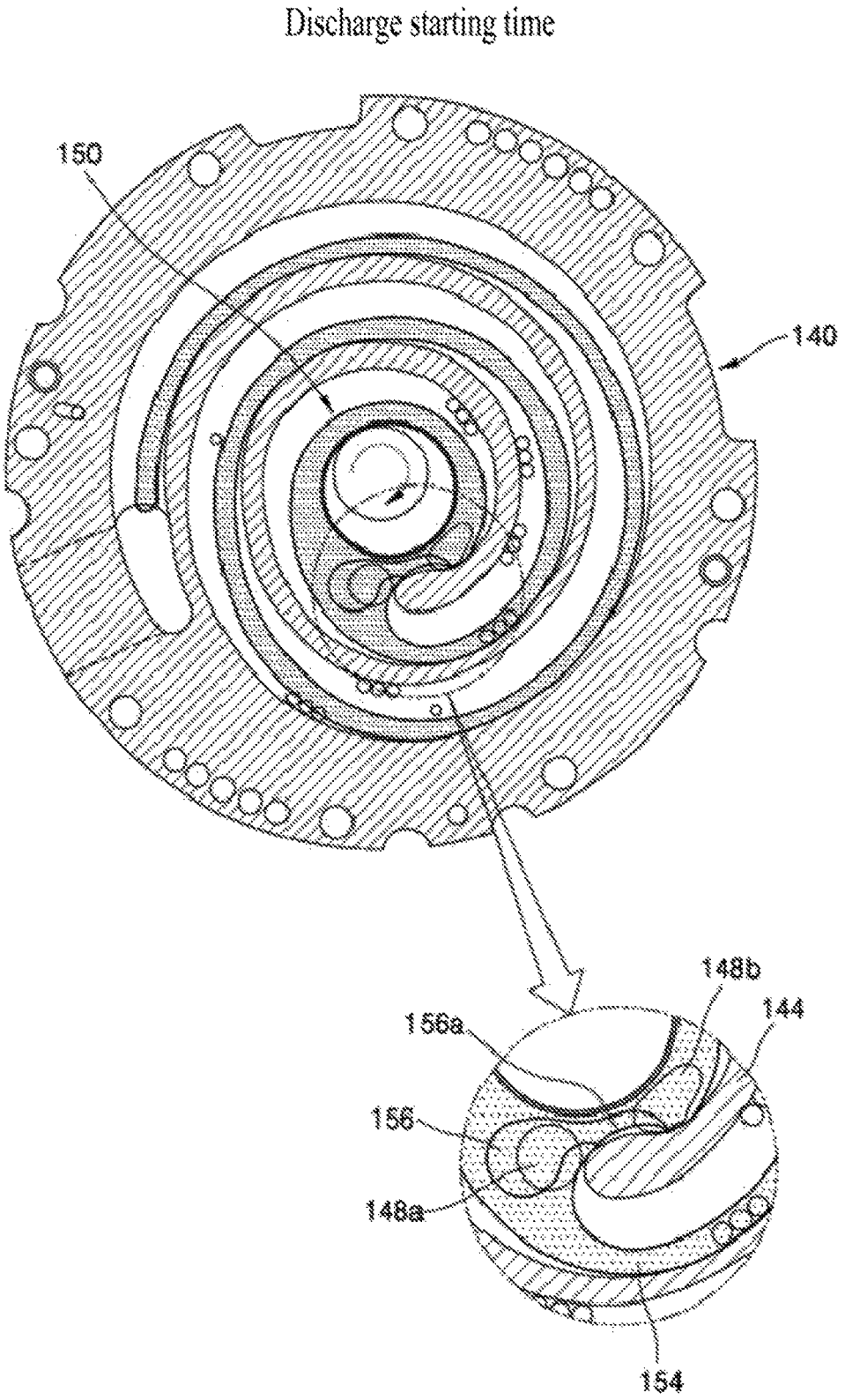
FIG. 7 is a view illustrating positions of a discharge hole and an auxiliary discharge path at a discharge starting time of a compressor according to the first embodiment of the present invention.

FIG. 7 illustrates a discharge starting time. Referring to FIG. 7, at the discharge starting time, the first discharge hole 148*a* is fully covered by the bottom surface of the orbiting wrap 154, and a lower portion of the second discharge hole 148*b* is partially opened to the compression chamber.

In case of the related art compressor which is not provided with the auxiliary discharge path 156, since the refrigerant can be discharged through only the discharge area of the second discharge hole 148*b*, a discharge flow velocity is very fast and discharge resistance is great.

However, if the auxiliary discharge path 156 which connects the side with the bottom surface of the orbiting wrap 154 is formed like this embodiment, the compressed refrigerant may enter the auxiliary discharge path 156 through the inlet 156*a* of the auxiliary discharge path 156 and then be discharged through the first discharge hole 148*a* overlapped with the auxiliary discharge path 156.

Also, the refrigerant entering the inlet 156*a* of the auxiliary discharge path 156 may be discharged through the second discharge hole 148*b* overlapped with the auxiliary discharge path 156.

The compressor according to the present invention may make sure of additional refrigerant discharge path through the auxiliary discharge path 156 formed in the orbiting wrap 154. This substantially results in an enlarging effect of an effective discharge area of the discharge hole.

As shown, the auxiliary discharge path 156 is arranged at an end area inside the orbiting wrap 154. An overlap area of the auxiliary discharge path 156 with the discharge holes 148*a* and 148*b* is changed in accordance with an orbiting movement of the orbiting wrap 154.

Referring to FIG. 7, at the discharge starting time, a wider area of the auxiliary discharge path 156 is overlapped with the first discharge hole 148*a*. In this case, it is noted that the overlap area of the auxiliary discharge path 156 with the first discharge hole 148*a* exists even before the discharge starting time.

However, since the discharge valve 149 (FIG. 2) is provided at the discharge outlet of the discharge holes 148*a* and 148*b*, the discharge valve 149 is not opened if the refrigerant does not reach a discharge pressure even though the refrigerant enters the auxiliary discharge path 156 before the discharge starting time.

Therefore, in the compressor according to the present invention, even though the auxiliary discharge path 156 is overlapped with the discharge holes 148*a* and 148*b* before the discharge starting time, the discharge through the auxiliary discharge path 156 may be blocked by the discharge valve 149.

Figure 8:
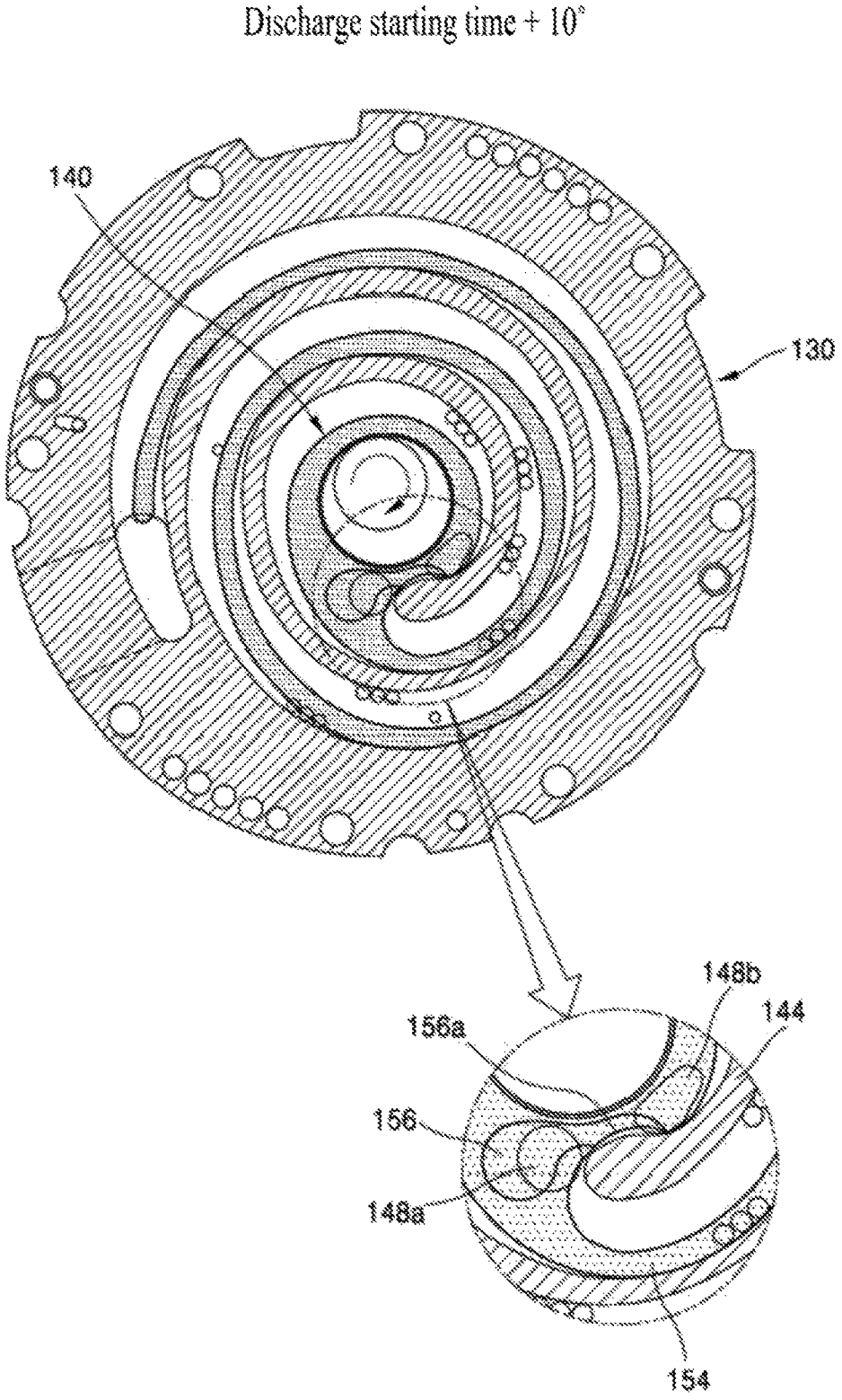
FIG. 8 is a view illustrating a state that a crank angle is rotated by addition of 10° at a discharge starting time in FIG. 7.

FIG. 8 illustrates a state that a crank angle is rotated by addition of 10° at a discharge starting time. Referring to FIG. 8 in comparison with FIG. 7, as the crank angle is rotated by addition of 10°, it is noted that the discharge area of the second discharge hole opened to the compression chamber is downsized and the first discharge hole 148*a* starts to open. However, it is noted that the entire discharge area of the discharge hole is narrow even in this state.

It is noted that the auxiliary discharge path 156 has a sufficient overlap area with the first discharge hole 148*a* and an overlap area with the second discharge hole 148*b* is close to twice of an area of the second discharge hole 148*b* directly opened to the compression chamber.

It is noted that the area of the second discharge hole 148*b* opened to the compression chamber is reduced while the crank angle is being rotated by addition of 10° from the discharge starting time and the area of the first discharge hole 148*a* opened to the compression chamber is increased but the discharge area of the discharge hole is not sufficient by only these areas.

However, if the auxiliary discharge hole 156 is formed in the orbiting wrap, since the area of the first discharge hole 148*a* and the second discharge area 148*b* covered by the orbiting wrap 154 may be used through the auxiliary discharge path 156, this substantially results in an enlarging effect of the discharge area.

Figure 9:
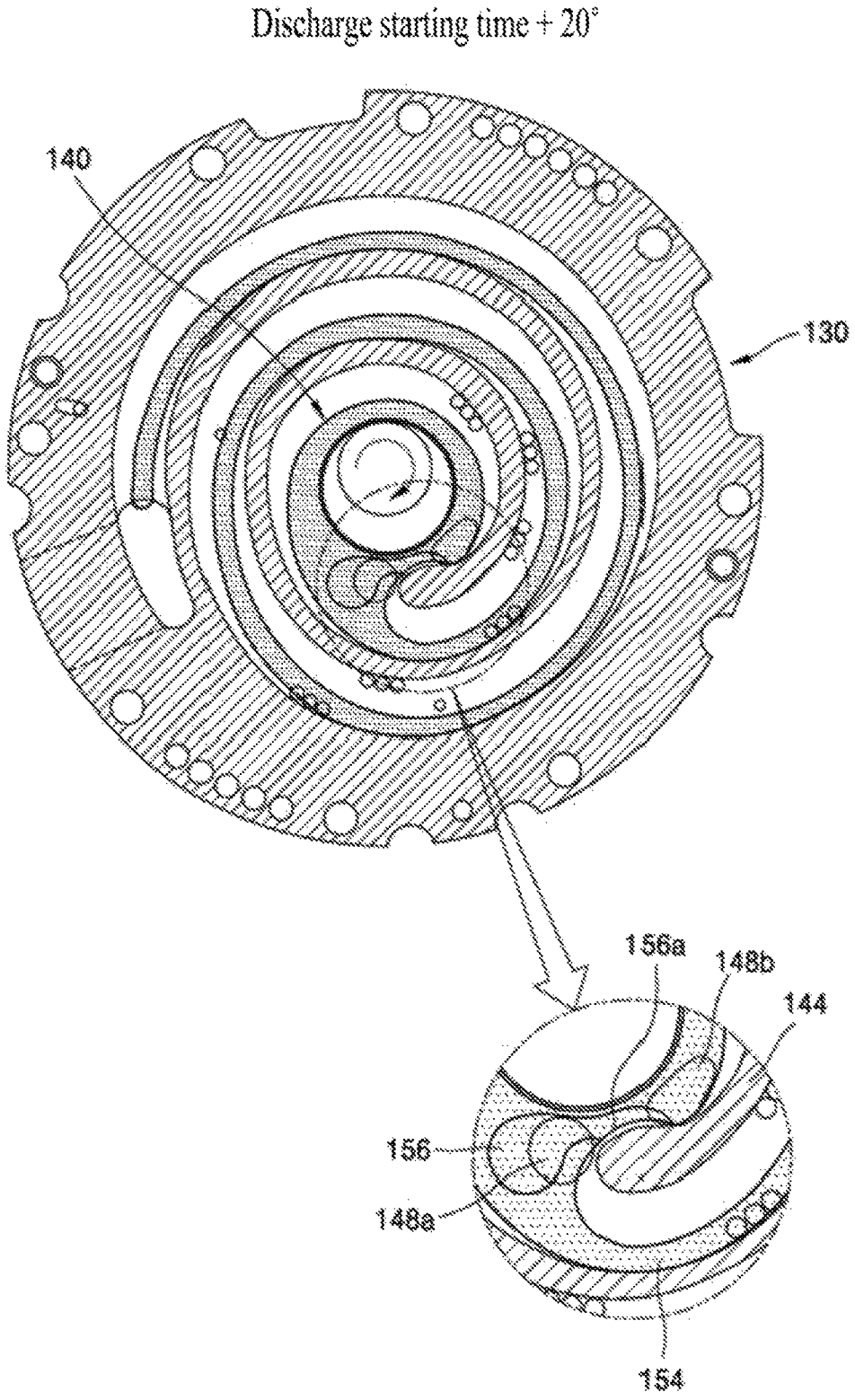
FIG. 9 is a view illustrating a state that a crank angle is rotated by addition of 20° at a discharge starting time in FIG. 7.

FIG. 9 is a view illustrating a state that a crank angle is rotated by addition of 20° at a discharge starting time.

Referring to FIG. 9 in comparison with FIG. 8, as the crank angle is rotated by addition of 10°, it is noted that the discharge area of the second discharge hole 148*b* opened to the compression chamber is downsized and an open area of the first discharge hole 148*a* is enlarged. However, it is noted that the entire discharge area of the discharge hole is very narrow even in this state.

It is noted that the auxiliary discharge path 156 has a sufficient overlap area with the first discharge hole 148*a* and an overlap area with the second discharge hole 148*b* is close to twice of an area of the second discharge hole 148*b* directly opened to the compression chamber.

Therefore, the compressed refrigerant may be discharge through the first discharge hole 148*a* overlapped with the auxiliary discharge path 156 and the second discharge hole 148*b* overlapped with the auxiliary discharge path 156 after passing through the inlet 156*a* of the auxiliary discharge path 156.

Figure 10:
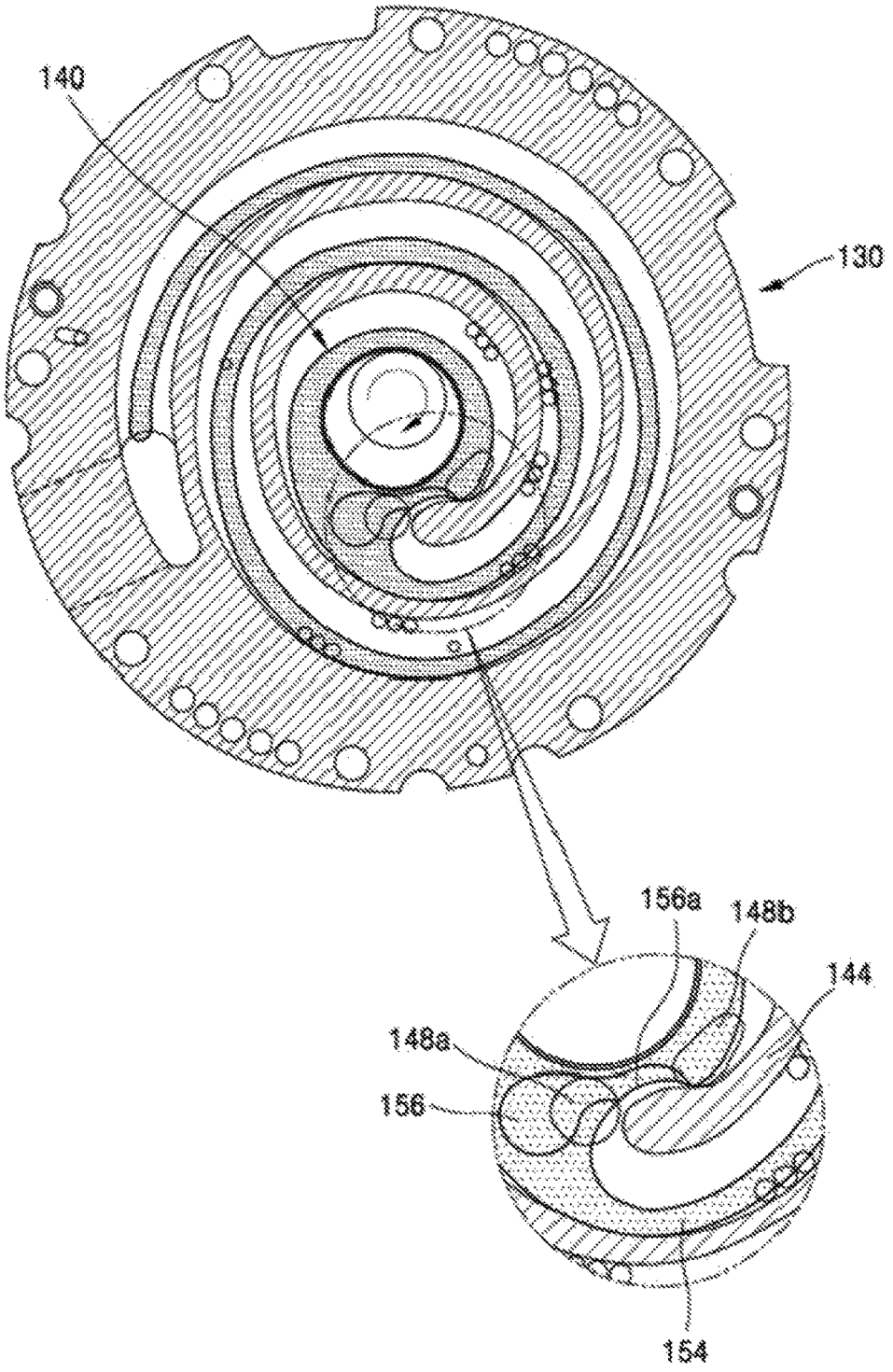
FIG. 10 is a view illustrating a state that a crank angle is rotated by addition of 30° at a discharge starting time in FIG. 7.

FIG. 10 is a view illustrating a state that a crank angle is rotated by addition of 30° at a discharge starting time.

Referring to FIG. 10 in comparison with FIG. 9, as the crank angle is rotated by addition of 10°, it is noted that the discharge area of the second discharge hole 148*b* opened to the compression chamber is downsized so that the second discharge hole 148*b* is almost closed, and the open area of the first discharge hole 148*a* is enlarged.

The discharge area of the first discharge hole 148*a* is 5% or less of the entire area of the first discharge hole 148*a* even in the state of FIG. 10.

Meanwhile, it is noted that the auxiliary discharge path 156 has an overlap area with the first discharge hole 148*a* within the range of 50% or more of the entire area of the first discharge hole 148*a*.

It is noted that the discharge area of the discharge paths 148*a* and 148*b* is narrow until the crank angle is rotated by addition of 30° at the discharge starting time, and thus it is useful to make sure of the discharge area through the auxiliary discharge path 156.

Figure 11:
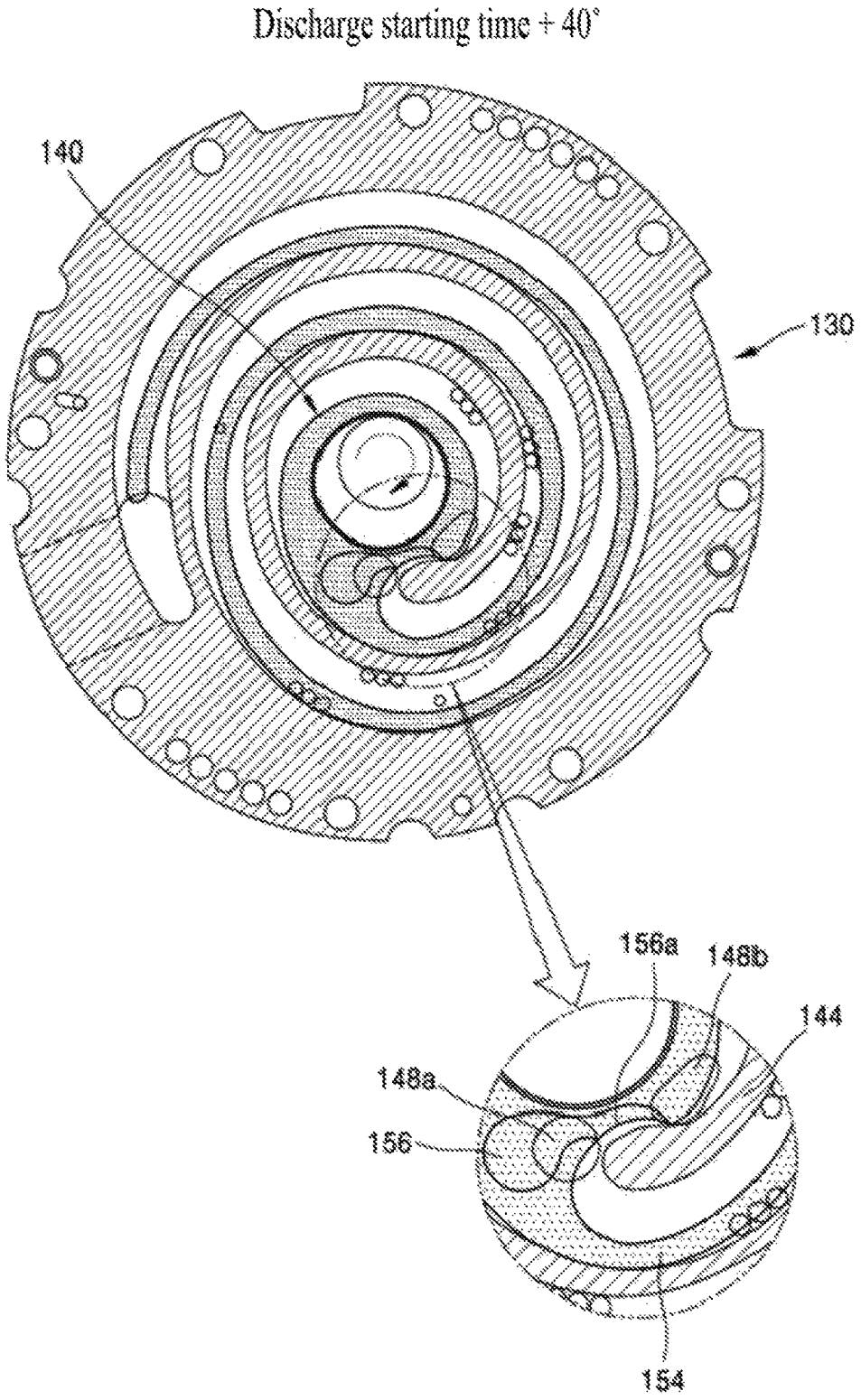
FIG. 11 is a view illustrating a state that a crank angle is rotated by addition of 40° at a discharge starting time in FIG. 7.

FIG. 11 is a view illustrating a state that a crank angle is rotated by addition of 40° at a discharge starting time.

Referring to FIG. 11 in comparison with FIG. 10, as the crank angle is rotated by addition of 10°, it is noted that a right lower portion of the second discharge hole 148*b* opened to the compression chamber is additionally opened to make sure of a discharge area and the discharge area of first discharge hole 148*a* is more enlarged.

At this time, the auxiliary discharge path 156 still makes sure of a sufficient area overlapped with the first discharge hole 148*a*.

In a state that the crank angle is rotated by addition of 40° at the discharge starting time, the discharge areas of the first discharge hole 148*a* and the second discharge hole 148*b* are obtained appropriately. However, even in this state, the compressed refrigerant may move through the auxiliary discharge path 156.

As described above, the auxiliary discharge path 156 results in an enlarging effect of an effective discharge area of the discharge hole by providing additional path through which the compressed refrigerant is discharged. Enlargement of the effective discharge area reduces a flow velocity of the refrigerant and discharge resistance.

Figure 12:
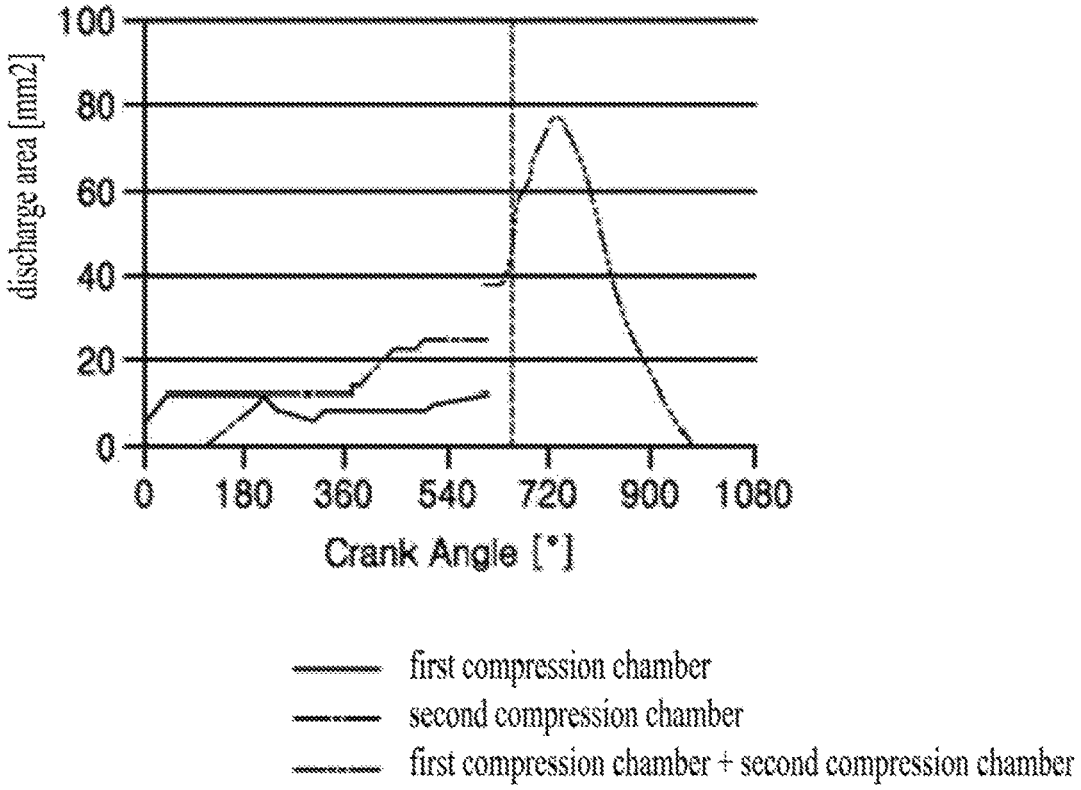
FIG. 12 is a graph illustrating a change of an open area of a discharge inlet according to a change of a crank angle of a compressor which is not provided with an auxiliary discharge path.
Figure 13:
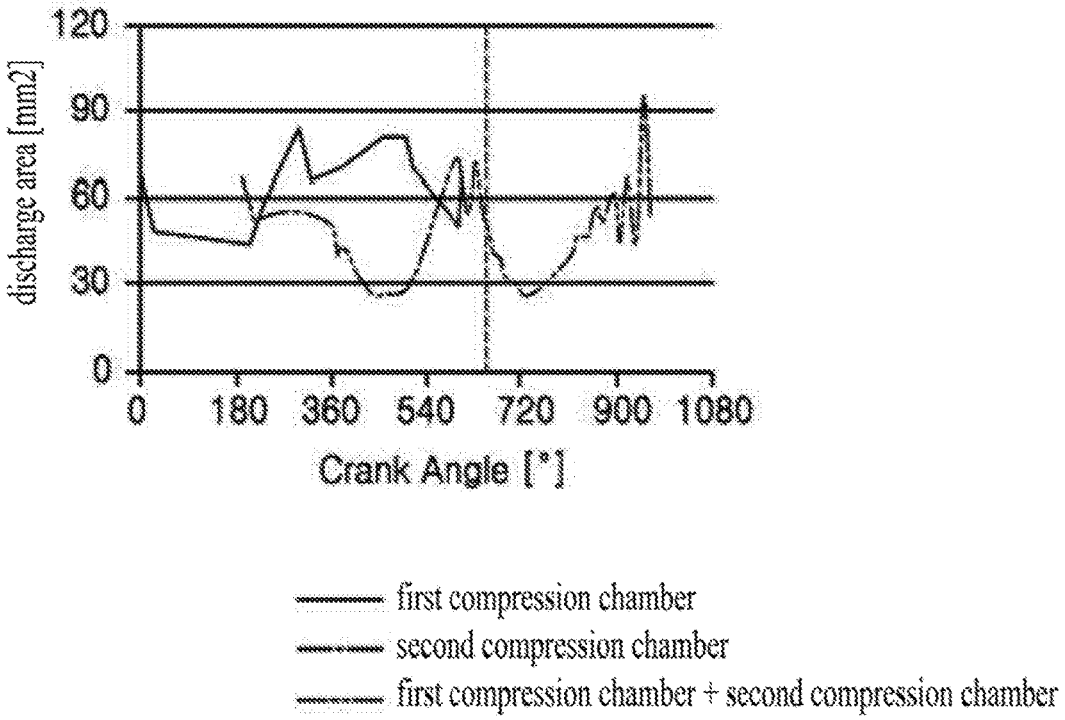
FIG. 13 is a graph illustrating a change of a flow velocity of a refrigerant according to a change of a crank angle of a compressor which is not provided with an auxiliary discharge path.

FIG. 12 is a graph illustrating a change of an open area of a discharge inlet according to a change of a crank angle of a compressor which is not provided with an auxiliary discharge path, and FIG. 13 is a graph illustrating a change of a flow velocity of a refrigerant according to a change of a crank angle of a compressor which is not provided with an auxiliary discharge path.

A discharge area opened to the first compression chamber and a discharge area opened to the second compression chamber are changed in accordance with a change of the crank angle. The first compression chamber and the second compression chamber are incorporated into one before the discharge starting time.

In this case, the discharge area includes an open area of the bypass hole 147 (FIG. 7) arranged on the moving path of the compression chamber. The bypass hole is intended to prevent the refrigerant from being overcompressed when the refrigerant of a liquid state enters there and to allow the compressed refrigerant to be discharged.

A flow velocity of the refrigerant is a numerical value obtained by dividing a volume downsizing rate of the compression chamber by an open area and then reversely counting the divided value.

Also, in the drawing, a dotted line denotes a point of a crank angle of 660° which is the discharge starting point.

If the refrigerant of a gaseous state is sucked and compressed, since the discharge is performed after the discharge starting time, an interval (interval of a crank angle of 660° or more) corresponding to the time after the discharge starting time is significant in the graph.

Referring to FIG. 12, the first compression chamber and the second compression chamber are incorporated into one before the discharge starting time. The open area of the discharge hole is measured at 50 $mm^2$, approximately at the discharge starting time.

Referring to FIG. 13, the flow velocity is measured at 49.6 m/s at the discharge starting time.

Figure 14:
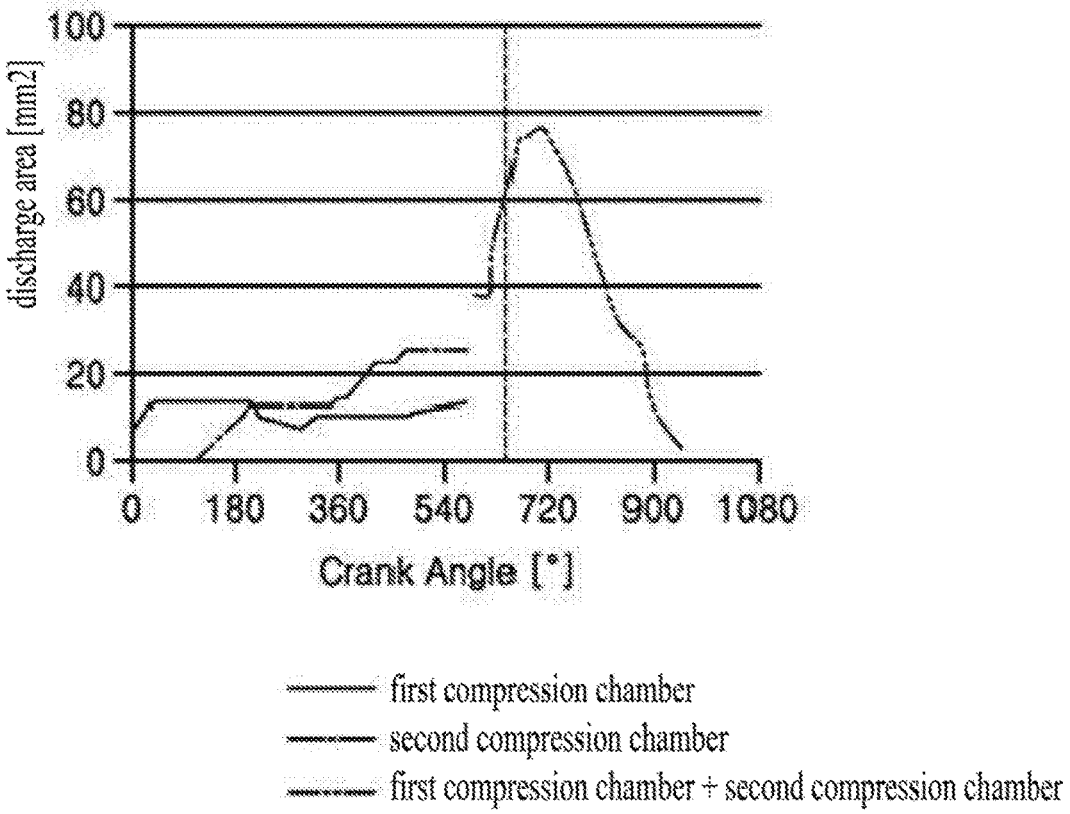
FIG. 14 is a graph illustrating a change of an open area of a discharge inlet according to a change of a crank angle of a compressor which is provided with an auxiliary discharge path in accordance with the first embodiment of the present invention.
Figure 15:
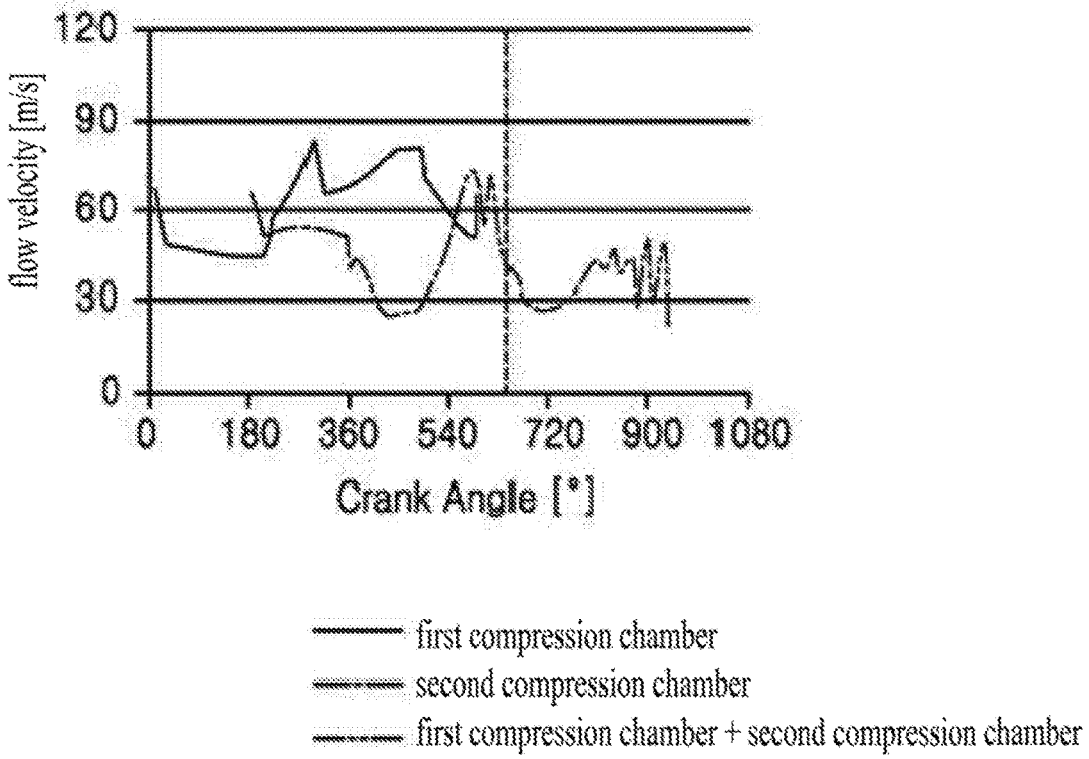
FIG. 15 is a graph illustrating a change of a flow velocity of a refrigerant according to a change of a crank angle of a compressor which is provided with an auxiliary discharge path in accordance with the first embodiment of the present invention.

FIG. 14 is a graph illustrating a change of an open area of a discharge inlet according to a change of a crank angle of a compressor which is provided with an auxiliary discharge path in accordance with the first embodiment of the present invention, and FIG. 15 is a graph illustrating a change of a flow velocity of a refrigerant according to a change of a crank angle of a compressor which is provided with an auxiliary discharge path in accordance with the first embodiment of the present invention.

In the compressor of FIGS. 14 and 15, the orbiting wrap has a height of 23 mm, the auxiliary discharge path has a depth of 3 mm, and the discharge starting time is a point of a crank angle of 660°.

In FIG. 14, the open area of the discharge hole at the discharge starting time is measured at 60 $mm^2$, approximately. Referring to FIG. 15, a flow velocity at the discharge starting time is measured at 42.2 mm/s.

Referring to FIGS. 14 and 15 in comparison with the FIGS. 12 and 13, as the auxiliary discharge path is formed in the compressor, the open area is increased as much as 10 $mm^2$ (20%), approximately. Also, as the auxiliary discharge path is formed in the compressor, the flow velocity of the refrigerant is reduced as much as 7.4 mm/s (15%), approximately.

Discharge loss may be devised from the flow velocity of the refrigerant which is discharged.

Discharge loss is proportional to kinetic energy of the refrigerant which is discharged. This is because that kinetic energy of the refrigerant which is discharged is generated from a work of the compressor.

Since the kinetic energy of the refrigerant is proportional to the square of a flow rate and velocity, a difference of discharge loss according to the presence of the auxiliary discharge path may simply be checked by a ratio of a value obtained by multiplying the square of the flow rate and the square of the velocity.

The value obtained by multiplying the square of the flow rate and the square of the velocity in the compressor which is not provided with the auxiliary discharge path of FIGS. 12 and 13 is computed as 90.2 $m^5/s^3$, and the value obtained by multiplying the square of the flow rate and the square of the velocity in the compressor which is provided with the auxiliary discharge path of FIGS. 14 and 15 is computed as 66.9 $m^5/s^3$.

It is noted that discharge loss is reduced as much as 26% because the auxiliary discharge path is formed.

It will be apparent to those skilled in the art that the present invention may be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

What is claimed is:

1. A compressor comprising:

a casing comprising a discharge portion disposed at a side of the casing, the discharge portion being configured to discharge refrigerant to an outside of the casing;

a driving motor coupled to the casing;

a main frame coupled to an inner circumferential surface of the casing;

a rotary shaft that is rotatably coupled to the driving motor and that passes through the main frame;

a fixed scroll comprising:

a fixed end plate portion coupled to the casing, the rotary shaft passing through the fixed end plate portion, wherein the fixed end plate portion defines a discharge hole that (i) extends through the fixed end plate portion, (ii) is spaced apart from the rotary shaft, and (iii) is configured to discharge refrigerant to an inside of the casing, and a fixed wrap that protrudes from the fixed end plate portion; and an orbiting scroll comprising:

an orbiting end plate portion disposed in the main frame and coupled to the rotary shaft, the rotary shaft passing through the orbiting end plate portion, and an orbiting wrap that protrudes from the orbiting end plate portion and that is engaged with the fixed wrap, wherein a center portion of the orbiting wrap is configured to open and close at least a portion of the discharge hole of the fixed scroll based on the orbiting scroll performing an orbiting movement relative to the fixed scroll by rotation of the rotary shaft, wherein the center portion of the orbiting wrap defines an auxiliary discharge path configured to guide refrigerant to the discharge hole, wherein the discharge hole comprises:

a first discharge hole that passes through a first portion of the fixed end plate portion, and a second discharge hole that is spaced apart from the first discharge hole and that passes through a second portion of the fixed end plate portion, wherein the auxiliary discharge path is configured to fluidly communicate the first discharge hole and the second discharge hole with each other, and wherein the auxiliary discharge path is configured to overlap with a portion of each of the first discharge hole and the second discharge hole without overlapping with an entire area of each of the first discharge hole and the second discharge hole.

2. The compressor of claim 1, wherein the auxiliary discharge path is recessed from a surface of the center portion of the orbiting wrap.

3. The compressor of claim 2, wherein the auxiliary discharge path is recessed toward an inside of the center portion, and wherein at least a portion of the auxiliary discharge path is configured to face the first discharge hole and the second discharge hole.

4. The compressor of claim 1, wherein the auxiliary discharge path extends toward the first discharge hole and the second discharge hole from a side of the orbiting wrap.

5. The compressor of claim 1, wherein the auxiliary discharge path comprises a recessed groove defined in the orbiting wrap.

6. The compressor of claim 1, wherein the auxiliary discharge path has an opening portion defined at a side of the orbiting wrap.

7. The compressor of claim 1, wherein the auxiliary discharge path is recessed from a surface of the orbiting end plate portion, and wherein a recessed depth of the auxiliary discharge path is less than a height of the orbiting wrap.

8. The compressor of claim 1, wherein the auxiliary discharge path is configured to receive refrigerant discharged from the rotary shaft toward an end of the fixed wrap.

9. The compressor of claim 1, wherein the auxiliary discharge path is configured to discharge refrigerant to at least one of the first discharge hole or the second discharge hole.

10. The compressor of claim 1, wherein the auxiliary discharge path comprises a first portion that faces the fixed end plate portion, and a second portion that faces the fixed wrap, and wherein an area of the first portion is greater than an area of the second portion.

11. The compressor of claim 1, wherein the auxiliary discharge path is configured to, based on a position of the orbiting scroll relative to the fixed end plate portion, define (i) a first overlapping area that is in fluid communication with the portion of the first discharge hole and (ii) a second overlapping area that is in fluid communication with the portion of the second discharge hole, and wherein the first overlapping area is less than the entire area of the first discharge hole, and the second overlapping area is less than the entire area of the second discharge hole.

12. The compressor of claim 11, wherein the first overlapping area is greater than the second overlapping area.

13. A compressor comprising:

a casing that defines an oil space therein;

a driving motor disposed inside the casing;

a main frame coupled to an inside of the casing and spaced apart from the driving motor;

a fixed scroll disposed at a side of the main frame, the fixed scroll comprising a fixed end plate portion and a fixed wrap that extends from the fixed end plate portion; and an orbiting scroll configured to perform an orbiting movement relative to the fixed scroll based on power supplied from the driving motor, the orbiting scroll comprising:

an orbiting end plate portion disposed in the main frame, and an orbiting wrap that extends from the orbiting end plate portion and that is engaged with the fixed wrap to thereby define a compression chamber, wherein the fixed scroll defines a discharge hole that passes through the fixed end plate portion and that is configured to discharge refrigerant compressed in the compression chamber to the inside of the casing, wherein the orbiting scroll defines an auxiliary discharge path that is disposed in the orbiting wrap and that is configured to allow the compression chamber to communicate with the discharge hole, wherein the discharge hole comprises:

a first discharge hole that passes through a first portion of the fixed end plate portion, and a second discharge hole that is spaced apart from the first discharge hole and that passes through a second portion of the fixed end plate portion, wherein the auxiliary discharge path is configured to fluidly communicate the first discharge hole and the second discharge hole with each other, and wherein the auxiliary discharge path is configured to overlap with a portion of each of the first discharge hole and the second discharge hole without overlapping with an entire area of each of the first discharge hole and the second discharge hole.

14. The compressor of claim 13, wherein the fixed scroll further comprises a discharge valve configured to open and close an outlet side of the discharge hole.

15. The compressor of claim 13, wherein the auxiliary discharge path comprises a recessed groove that is recessed by a predetermined depth from a surface of the orbiting wrap that is in contact with the fixed end plate portion.

16. The compressor of claim 13, wherein the auxiliary discharge path has an opening portion that extends to the compression chamber and that is configured to receive refrigerant in the compression chamber.

* * * * *